US007722243B2

(12) United States Patent
Schumacher et al.

(10) Patent No.: US 7,722,243 B2
(45) Date of Patent: May 25, 2010

(54) AUTOMATIC DRUM ROTATION CONTROL CONCRETE TRANSIT MIXER TRUCK

(75) Inventors: Charles P. Schumacher, Cedarburg, WI (US); Alexander Krasny, Eagan, MN (US); Heinz Ulrich Worthmann, Lino Lakes, MN (US); Robert Benjamin Durand, Plymouth, MN (US); Carl Phillip Quist, Maplewood, MN (US)

(73) Assignee: Schwing America, Inc., White Bear Lake, MN (US)

( * ) Notice: Subject to any disclaimer, the term of this patent is extended or adjusted under 35 U.S.C. 154(b) by 826 days.

(21) Appl. No.: 11/641,392

(22) Filed: Dec. 19, 2006

(65) Prior Publication Data

US 2008/0144424 A1 Jun. 19, 2008

(51) Int. Cl.
*B28C 5/42* (2006.01)
*B28C 7/02* (2006.01)

(52) U.S. Cl. ..... 366/3; 366/61

(58) Field of Classification Search ..... 366/3, 366/12, 53, 60, 61
See application file for complete search history.

(56) References Cited

U.S. PATENT DOCUMENTS

| | | | | |
|---|---|---|---|---|
| 2,968,915 | A * | 1/1961 | Feistel, Jr. | 60/435 |
| 3,080,152 | A * | 3/1963 | Lendved | 366/44 |
| 4,585,356 | A * | 4/1986 | Hudelmaier | 366/60 |
| 6,286,987 | B1 * | 9/2001 | Goode et al. | 366/60 |
| 6,938,716 | B1 * | 9/2005 | Eull | 180/282 |
| 2005/0004733 | A1 * | 1/2005 | Pillar et al. | 701/48 |
| 2007/0247964 | A1 * | 10/2007 | Ross et al. | 366/61 |
| 2008/0144424 | A1 * | 6/2008 | Schumacher et al. | 366/3 |

* cited by examiner

*Primary Examiner*—Tony G Soohoo
(74) *Attorney, Agent, or Firm*—Kinney & Lange, P.A.

(57) ABSTRACT

A concrete transit mixer truck includes a control system that automatically controls rotation of the mixer drum at a constant drum speed when the mixer truck is traveling. When sensed speed of the truck exceeds a threshold, the control system automatically causes a hydraulic system to rotate the drum at a constant speed, regardless of the truck engine speed.

24 Claims, 2 Drawing Sheets

AUTOMATIC DRUM ROTATION CONTROL CONCRETE TRANSIT MIXER TRUCK

BACKGROUND OF THE INVENTION

The present invention relates to concrete transit mixing trucks. In particular, the invention relates to a control system for controlling rotation of the drum of the mixer truck while the truck is in motion.

Concrete transit mixer trucks are used to transport concrete to a worksite while mixing or agitating the payload of cement, aggregate, sand and water. Fins within the drum mix the payload as the drum rotates.

As the concrete constituents are initially loaded into the drum, and as the truck moves to the worksite, the drum is rotated in a first or charge direction, so that the payload tends to move away from discharge opening of the drum. At the worksite, the rotation of the drum is reversed so that it rotates in a second or discharge direction. The fins move the payload toward the discharge opening. A chute attached below the discharge opening delivers the concrete from the drum to the worksite.

The drum is rotated by a hydraulic drive. A hydraulic motor in the hydraulic drive is driven by the truck engine through a power takeoff connection. As a result, the speed of the hydraulic motor driving the drum will vary with engine speed.

The constantly moving concrete within the drum contacts the interior of the drum and fins. Over time, the fins and the interior lining of the drum will be worn to an extent that they require replacement. The replacement of the drum and the fins is an expensive repair.

On average, the drum and fins of a concrete transit mixer truck will require replacement about every 1.5 million revolutions of the drum. Thus, the faster the drum is rotated on average, the sooner the drum and fins will require replacement.

Some concrete transit mixer trucks have been provided with a constant drum speed feature, in which the hydraulic motor is operated at a constant speed, rather than at a variable speed that is a function of the truck engine speed. By using the constant drum speed feature while the truck is traveling to the worksite, the constant rotational speed of the drum will generally be less than the average rotational speed of the drum if the hydraulic motor were allowed to vary with engine speed. A 30 to 40 percent reduction in the number of revolutions can be achieved if constant drum speed is used whenever the truck is traveling to or from a worksite. This can yield significant benefits in maintenance costs for the truck. In addition, it can result in significant savings in fuel and a gain in effective horsepower, because the drum is not accelerated whenever the engine accelerates.

Despite the benefits of a constant drum speed feature, it has not achieved widespread usage, even among businesses owning the trucks with the constant drum speed feature. Because the driver must turn on the constant drum speed feature when traveling, the use of the constant speed feature is dependent upon the driver remembering to activate the system. In addition, many drivers believe that they can control the truck and the drum better themselves manually, and therefore choose not to use the constant speed feature.

BRIEF SUMMARY OF THE INVENTION

A control system for transit mixer truck automatically controls the drum drive system based upon sensed vehicle speed.

When the speed of the transit mixer truck exceeds a threshold, the control system causes the drum drive system to rotate the drum at a constant speed.

DETAILED DESCRIPTION

Figure 1:
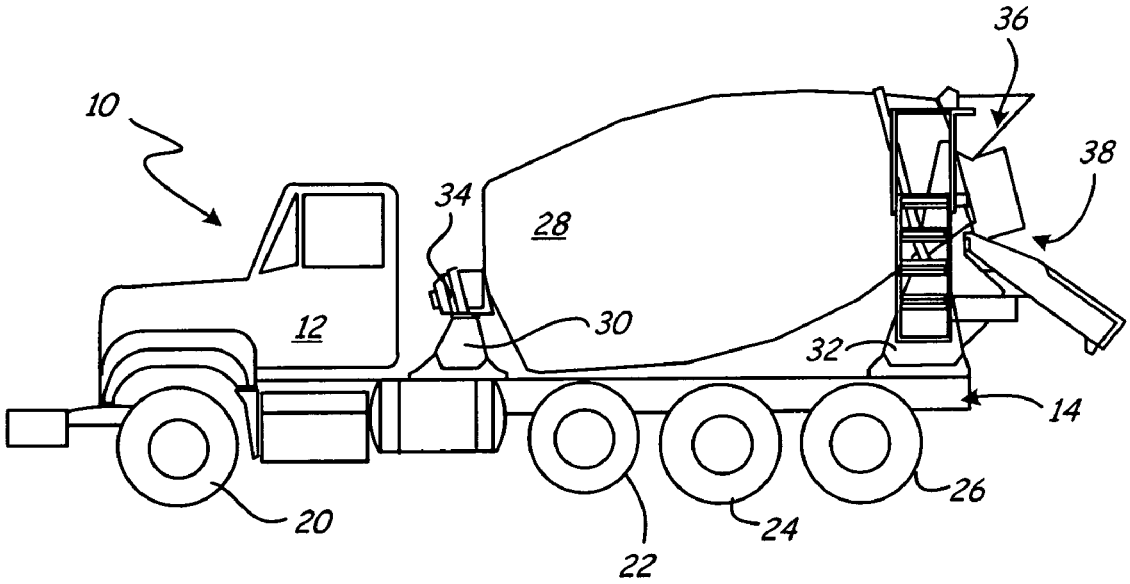
FIG. 1 shows a side view of a concrete transit mixer truck.

FIG. 1 is a side view of concrete mixing truck 10, which includes cab 12, chassis 14, wheels 20, 22, 24 and 26, drum 28, front pedestal 30, rear pedestal 32, hydraulic drive 34, discharge opening 36, and chute 38. Mixer drum 28 holds and mixes concrete, and is supported by chassis 14 between front pedestal 30 and rear pedestal 32. Rear pedestal 30 has a greater height than front pedestal 32, so that the rear of drum 28 is elevated.

Hydraulic drive 34 rotates drum 28 in a charge direction to mix the concrete while truck 10 is traveling to the work site. When truck 10 is in position at the work site to deliver the concrete, the driver causes hydraulic drive 34 to reverse the rotation of drum 28 so that it rotates in the discharge direction. As the drum rotates, the fins within drum 28 move the concrete toward discharge opening 36. The concrete is delivered out of drum 28 through discharge opening 36 and down chute 38.

Hydraulic drive 34 is driven by a power take-off from the engine of truck 10. As engine speed varies, the input drive to hydraulic drive 34 changes speed, which will result in a change in the speed of rotation of drum 28. With the present invention, a control system automatically engages hydraulic system 34 to operate at a constant speed whenever truck 10 is in motion. The control system receives a signal representative of sensed vehicle speed, and compares that speed to a threshold value. When the sensed vehicle speed is greater than the threshold, the control system engages hydraulic drive 34 to operate at a constant speed. The speed of rotation of drum 28 in the constant drum speed mode is preferably high enough to keep the payload within drum 28 in motion, but low enough to extend the usable life of the drum and fins, as well as saving energy costs and reducing the amount of horsepower of the truck engine that is used for drum rotation. The rotational speed in the constant drum speed mode is less than about 2 revolutions per minute, and preferably about 1 revolution per minute.

Figure 2:
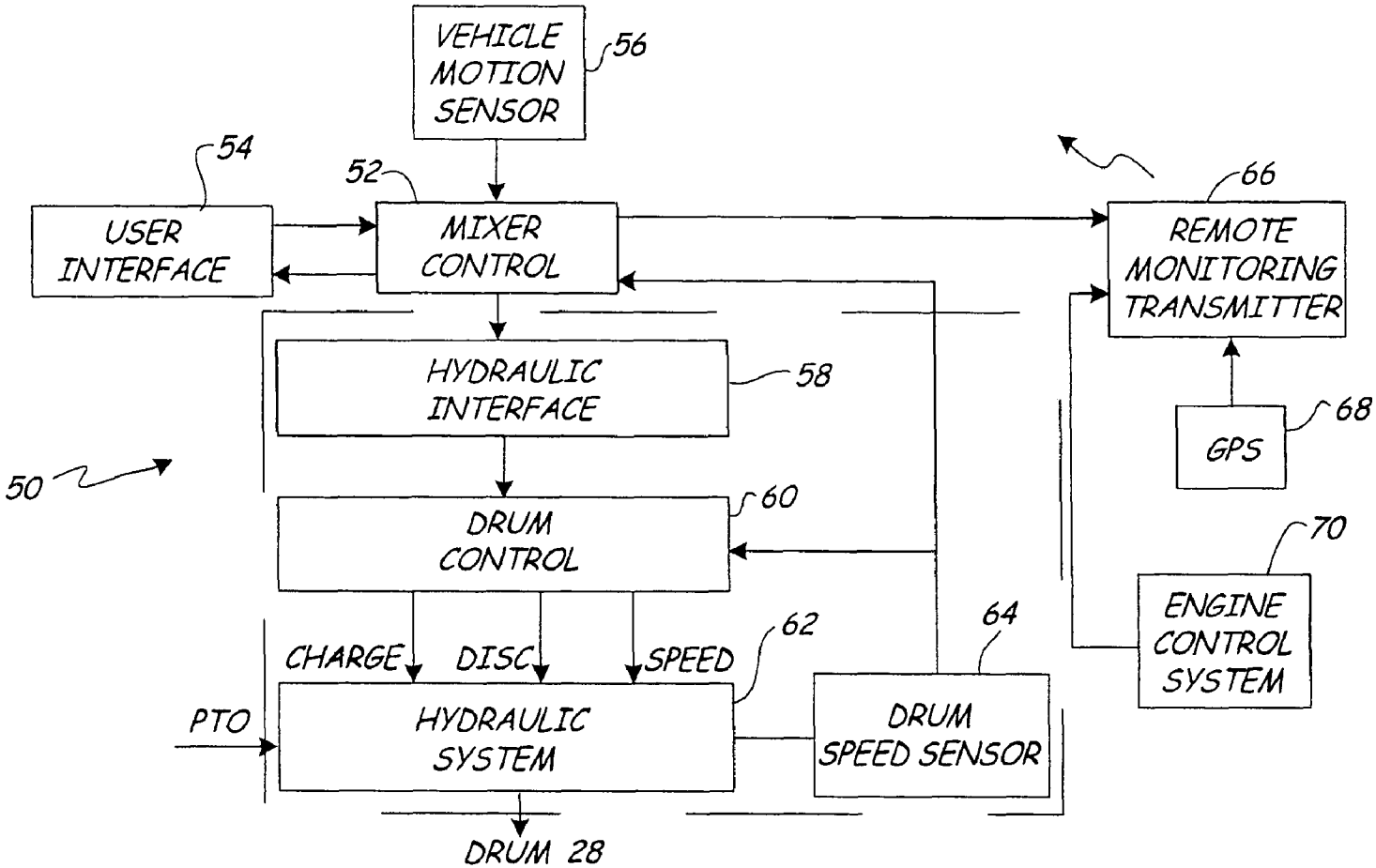
FIG. 2 is a block diagram of a control system for automatically controlling drum rotation at a constant speed whenever the truck is traveling.

FIG. 2 is a block diagram showing control system 50, which automatically controls drum rotation based upon sensed vehicle speed. As shown in FIG. 2, control system 50 includes mixer control 52, user interface 54, vehicle motion sensor 56, hydraulic interface 58, drum control 60, hydraulic system 62, drum speed sensor 64, remote monitoring transmitter 66, GPS system 68 and engine control system 70.

Mixer control 52 controls the operation of hydraulic system 62 through hydraulic interface 58 and drum control 60. Based upon control signals supplied by mixer control 52 through hydraulic interface 58, drum control 60 provides charge, discharge and speed control signals to hydraulic system 62. The charge and discharge signals control the direction of rotation of hydraulic system 62. The speed control signal controls the speed at which hydraulic system 62 drives drum 28. Hydraulic system 62 receives its input power from the power take off (PTO) output of the truck engine.

Drum speed sensor 64 provides a drum speed signal as feedback to drum control 60 or mixer control 52, or both, as shown in FIG. 2. The drum speed sensor signal allows closed loop control by either mixer control 52 or drum control 60 when system 50 is operating in a constant drum speed mode.

Mixer control 52 receives a signal from vehicle in motion sensor 56 which indicates to mixer control 52 whether truck 10 is in motion. If truck 10 is moving at greater than a threshold speed (such as 10 mph), mixer control 52 provides control signals through hydraulic interface 58 to drum control 60 to cause hydraulic system 62 to operate in the charge direction at a constant speed of, for example, 1 revolution per minute.

Once the constant drum speed mode has been initiated, mixer control 52 will maintain hydraulic system 62 in the constant drum speed mode until mixer control 52 receives an input from user interface 54 that either selects manual operation, or selects a discharge mode. Mixer control 52 provides signals to user interface 54 to operate indicators or displays so that the driver can determine what mode system 62 is currently operated in.

Vehicle motion sensor 56 can take a number of different forms to provide a signal representative of vehicle speed. For example, in one embodiment vehicle motion sensor 56 is a magnetic sensor positioned adjacent the drive shaft of truck 10. A magnet is mounted on the drive shaft, so that each time the drive shaft goes through a full revolution, the magnet passes the magnetic sensor, and a pulse is generated. Based upon the pulses generated by the magnet sensor, a vehicle speed signal can be generated.

In another embodiment, vehicle motion sensor 56 is a part of GPS system 58, and makes use of a speed over ground signal derived by GPS system 68. The vehicle motion signal can also be derived from the speedometer of truck 10, or from any other location or device where a signal representative of vehicle speed can be derived.

Mixer control 52 also communicates with remote monitoring transmitter 66, which can communicate wirelessly with a remote monitoring system to provide information about operation of truck 10 while it is at the job site or traveling to or from the job site. Remote monitoring transmitter 66 receives information from GPS system 68, so that the location of truck 10 can be remotely monitored, and information from engine control system 70 so that the operation of truck 10 can be monitored remotely.

The signal from mixer control 52 to remote monitoring transmitter 66 provides an indication of when drum 28 is being rotated in the constant drum speed mode. If the driver chooses to override the automatic constant drum speed feature, that information is reported to the remote monitoring system. The information allows management to determine whether its drivers are deliberately overriding the automatic constant drum speed feature, and thus impacting the savings in maintenance and fuel costs that can be gained if the automatic constant drum speed feature is used.

The information provided to the remote monitoring system from mixer control 52 can also include information on drum speed, based upon feedback from drum speed sensor 64. This can allow management to show the driver the variations in drum speed that occur when the driver overrides the automatic constant drum speed feature.

The data relating to operation in constant drum speed mode, and driver overrides of that mode, as well as drum speed data, can also be stored in memory by mixer control 52. The memory can later be interrogated in order to evaluate the performance of control system 50 and the driver. Storage of data in memory carried on truck 10 may be an alternative for those trucks that do not have a remote monitoring capability.

The automatic constant drum speed feature eliminates the need for the driver to remember to use the feature. Since the initiation of the constant drum speed mode is triggered by vehicle speed exceeding a threshold, the use of the feature can be maximized. As a result, significant savings in maintenance and fuel costs can be achieved.

Although the present invention has been described with reference to preferred embodiments, workers skilled in the art will recognize that changes may be made in form and detail without departing from the spirit and scope of the invention.

The invention claimed is:

1. A concrete transit mixer truck comprising:
a drum;
a hydraulic system for rotating the drum;
a vehicle motion sensor for providing a vehicle motion signal indicative of vehicle speed; and
a control system for controlling the hydraulic system, when the vehicle speed exceeds a threshold speed, to rotate the drum at a constant drum speed.

2. The truck of claim 1, wherein the vehicle motion sensor senses rotation of a drive shaft of the truck.

3. The truck of claim 1, wherein the vehicle motion sensor determines vehicle speed based upon GPS signals.

4. The truck of claim 1, wherein the constant drum speed is less than about 2 rpm.

5. The truck of claim 4, wherein the constant drum speed is about 1 rpm.

6. The truck of claim 1, and further comprising:
a manual override input for producing a signal to cause the control system to allow a driver to control drum speed.

7. The truck of claim 1, wherein the control system maintains rotation of the drum at a constant drum speed until either a manual override input or a discharge input is received.

8. The truck of claim 1 and further comprising:
a transmitter for transmitting information relating to rotation of the drum to a remote monitoring system.

9. A method of controlling concrete transit mixer truck, comprising the method:
sensing vehicle speed of the truck; and
controlling rotation of a mixer drum of the truck to rotate the drum at a constant drum speed when the sensed vehicle speed indicates that the truck is traveling.

10. The method of claim 9, wherein sensing vehicle speed comprises sensing rotation of a drive shaft of the truck.

11. The method of claim 9, wherein sensing vehicle speed comprises determining vehicle speed based upon GPS signals.

12. The method of claim 9, wherein the constant drum speed is less than about 2 rpm.

13. The method of claim 12, wherein the constant speed is about 1 rpm.

14. The method of claim 9, and further comprising:
receiving a manual override input; and
allowing a driver to control drum speed manually.

15. The method of claim 9, and further comprising:
maintaining rotation of the drum at the constant drum speed until either a manual override input or a discharge input is received.

16. The method of claim 9 and further comprising:
transmitting information relating to rotation of the drum to a remote monitoring system.

17. An automatic constant drum speed control for a concrete transit mixer truck, the control comprising:
means for determining when the truck is moving at greater than a threshold vehicle speed; and means for controlling rotation of a mixer drum of the truck at a constant speed in response to a determination that the truck is moving at greater than the threshold vehicle speed.

18. The control of claim 17, wherein the means for determining senses rotation of a drive shaft of the truck.

19. The control of claim 17, wherein the means for determining uses GPS signals to determine vehicle speed.

20. The control of claim 17, wherein the constant drum speed is less than about 2 rpm.

21. The control of claim 20, wherein the constant drum speed is about 1 rpm.

22. The control of claim 17, and further comprising:

a manual override input for producing a signal to cause the means for controlling to allow a driver to control drum speed manually.

23. The control of claim 17, wherein the means for controlling maintains rotation of the drum at a constant drum speed until either a manual override input or a discharge input is received.

24. The control of claim 17 and further comprising:

a transmitter for transmitting information relating to rotation of the drum to a remote monitoring system.

* * * * *